US009376174B2

(12) United States Patent
Morimoto

(10) Patent No.: US 9,376,174 B2
(45) Date of Patent: Jun. 28, 2016

(54) METHOD OF MANUFACTURING LIQUEFIED NATURAL GAS CARRIER

(76) Inventor: Nobuyoshi Morimoto, Tokyo (JP)

( * ) Notice: Subject to any disclaimer, the term of this patent is extended or adjusted under 35 U.S.C. 154(b) by 0 days.

(21) Appl. No.: 14/234,991

(22) PCT Filed: Jul. 25, 2012

(86) PCT No.: PCT/JP2012/068769

§ 371 (c)(1),
(2), (4) Date: Mar. 5, 2014

(87) PCT Pub. No.: WO2013/015296

PCT Pub. Date: Jan. 31, 2013

(65) Prior Publication Data

US 2014/0174333 A1 Jun. 26, 2014

(30) Foreign Application Priority Data

Jul. 25, 2011 (JP) ..... 2011-161704

(51) Int. Cl.
*B63B 25/08* (2006.01)
*B63B 25/16* (2006.01)
(Continued)

(52) U.S. Cl.
CPC ..... *B63B 25/16* (2013.01); *B63B 11/00* (2013.01); *F17C 13/082* (2013.01); *B63B 2025/087* (2013.01); *F17C 2201/0157* (2013.01); *F17C 2201/052* (2013.01); *F17C 2203/0333* (2013.01); *F17C 2203/0651* (2013.01); *F17C 2205/013* (2013.01); *F17C 2205/018* (2013.01); *F17C 2205/0188* (2013.01); *F17C 2221/033* (2013.01); *F17C 2223/0161* (2013.01); *F17C 2223/033* (2013.01); *F17C 2260/016* (2013.01); *F17C 2265/05* (2013.01); *F17C 2270/0105* (2013.01);
(Continued)

(58) Field of Classification Search
CPC .... B63B 25/16; B63B 11/00; B63B 2025/087
USPC ..... 114/65 R, 72, 73, 74 R, 74 T, 74 A
See application file for complete search history.

(56) References Cited

U.S. PATENT DOCUMENTS 3,851,611 A * 12/1974 Yamamoto ..... 114/74 A
3,941,272 A 3/1976 McLaughlin
(Continued)

FOREIGN PATENT DOCUMENTS

GB 1 531 174 A 11/1978
JP 2000177681 A 6/2000
JP 2003252287 A 9/2003
(Continued)

*Primary Examiner* — Daniel V Venne
(74) *Attorney, Agent, or Firm* — Muncy, Geissler, Olds & Lowe, P.C.

(57) ABSTRACT

Provided a LNG ship that is manufactured in a short construction period by assembling a LNG tank on land and mounting the LNG tank in a hold of the ship.

A cold insulator and a membrane are affixed on an inner side of a prismatic tank to fabricate a LNG tank, which is mounted in a hold having a double hull structure. In order to prevent the prismatic tank from deforming at the time of the mounting, strength members are welded to an outer surface of the prismatic tank before a thermal insulation work for the purpose of sufficient reinforcement. After the tank is mounted in the hold, the strength members of the prismatic tank are coupled to the inner hull of the ship to integrate the LNG tank and the hull, so that the weight of a liquid cargo is supported by the prismatic tank and the hull together.

2 Claims, 4 Drawing Sheets

(51) Int. Cl.
*B63B 11/00* (2006.01)
*F17C 13/08* (2006.01)

(52) U.S. Cl.
CPC .... *F17C 2270/0113* (2013.01); *Y10T 29/49622* (2015.01)

(56) References Cited

U.S. PATENT DOCUMENTS 5,727,492 A * 3/1998 Cuneo et al. ..... 114/74 A
2003/0057214 A1 3/2003 Miller et al.

FOREIGN PATENT DOCUMENTS

| | | | |
|---|---|---|---|
| JP | 2010-236583 | A | 10/2010 |
| KR | 10-2007-0042536 | A | 4/2007 |
| KR | 10-0718482 | B1 | 5/2007 |
| KR | 20100039482 | | 4/2010 |
| KR | 10-1041782 | | 6/2011 |
| WO | WO 00/21847 | A1 | 4/2000 |
| WO | WO 2006/001711 | A2 | 1/2006 |

* cited by examiner

METHOD OF MANUFACTURING LIQUEFIED NATURAL GAS CARRIER

TECHNICAL FIELD

The present invention relates to a method of manufacturing a liquefied natural gas carrier.

BACKGROUND ART

Types of tank structures of conventional LNG ships are roughly divided into a self-supporting spherical tank, a self-supporting prismatic tank (SPB) type, and a membrane tank. An independent spherical tank is a self-supporting spherical tank made of an aluminum alloy and is supported in a hold formed by a double hull, via a skirt extending from its equatorial portion. A thermal insulation work is done on an outer surface of the tank. Due to its spherical shape, the spherical tank has a disadvantage of not being capable of having a sufficient tank volume comparable to the size of the hull. The tank of this type little suffers damage even when its cargo sloshes at the time of heavy weather.

The self-supporting prismatic tank is one in which a prismatic tank is housed in a hold having a double hull structure. A cold insulator is provided on an outer surface of the prismatic tank made of an aluminum alloy. Strength members for the prismatic tank are provided on an inner side of the tank. This type requires void space between the prismatic tank and an inner hull, which accordingly reduces volumetric efficiency of the tank. On the other hand, having the strength members inside the tank, it has an advantage that sloshing of a liquid cargo does not easily occur.

Next, regarding the membrane type, on an inner surface of a hold having a double hull structure, thin sheets (membranes) made of nickel steel or stainless steel are affixed, with a cold insulator therebetween, to form a LNG tank. This type has an advantage that almost all the volume of the hold can be used as a tank volume. On the other hand, it has a disadvantage that the membranes and the cold insulator are likely to suffer damage due to the sloshing of a liquid cargo. It also has a problem that a thermal insulation work, in particular, the welding of the membranes is complicated and it requires a long period for the construction.

SUMMARY OF INVENTION

It is an object of this invention to provide a method of manufacturing a liquefied natural gas carrier on which-LNG tank is mounted, the LNG tank not easily suffering damage by sloshing of a liquid cargo at the time of heavy weather and in addition capable of being constructed in a short construction period.

According to a method of manufacturing a liquefied natural gas carrier of this invention, the LNG tank assembled on land is mounted and fixed in a hold having a double hull structure. This LNG tank has a prismatic tank, and a heat insulator and a membrane are attached on an inner surface of the container. Strength members are disposed on an outer surface of the prisnmatic tank in advance to reinforce the prismatic tank. After the LNG tank is mounted in the hold, the strength members are connected to the hull. Therefore, a characteristic lies in that the weight of a liquid cargo is not supported only by the prismatic tank but is supported by the prismatic tank and the hull structure together.

In this LNG ship, the heat insulation and membrane work of the LNG tank can be done on land, which can greatly shorten a construction period for building the LNG ship as compared with conventional methods. Further, arranging the LNG tanks in two lines in the hold reduces the area of a horizontal cross section of each of the LNG tanks, which has an effect of making the occurrence of sloshing difficult.

DESCRIPTION OF EMBODIMENTS

Figure 3:
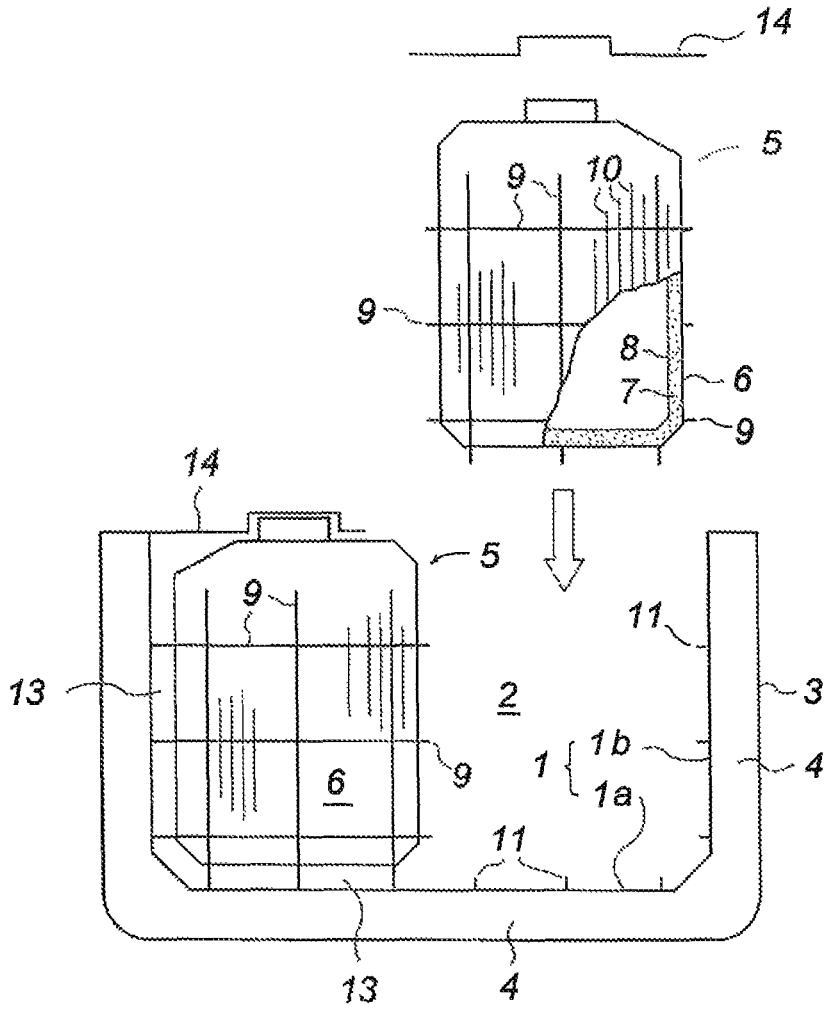
FIG. 3 is a cross section of the center portion of the hull of the LNG ship which is under construction.

As shown in FIG. 3, this LNG carrier has a double hull structure, and a hold 2 is formed, being surrounded by an inner hull 1 (that is, an inner bottom 1*a* and longitudinal bulkheads 1*b*). Space between the inner hull 1 and a shell plate 3 is used as a ballast tank 4.

Figure 1:
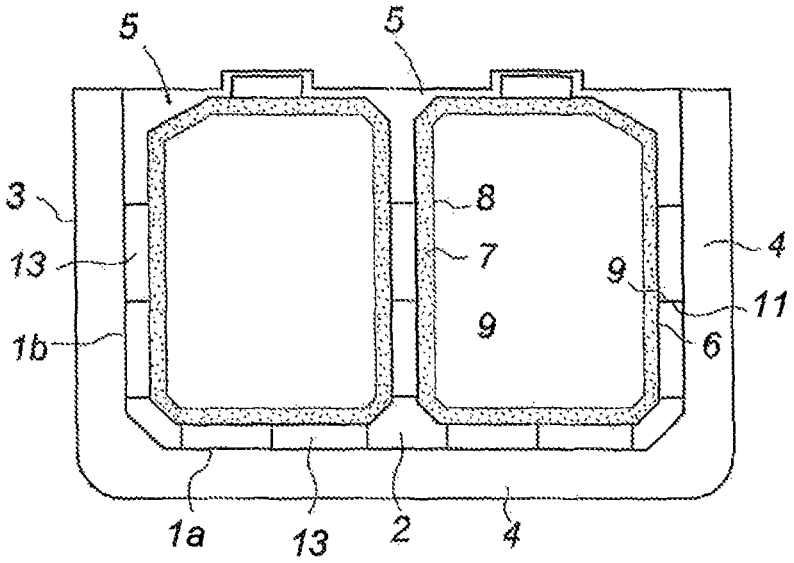
FIG. 1 is a cross section of a center portion of a hull of a LNG ship.
Figure 2:
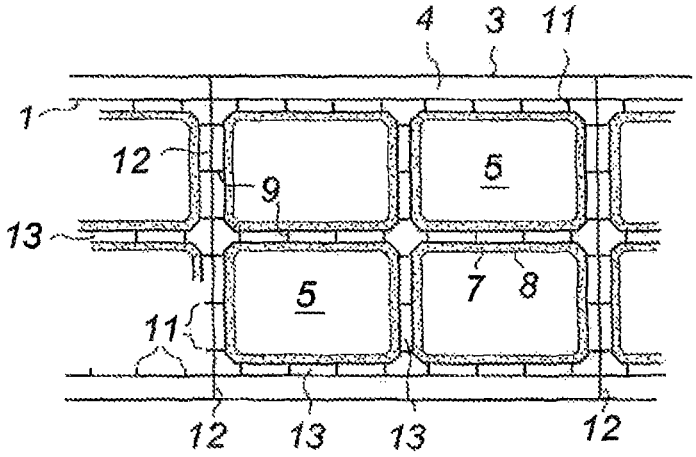
FIG. 2 is a horizontal cross-sectional view of the center portion of the hull of the LNG ship.

LNG tanks 5 assembled on land in advance are mounted in each of these holds 2. The smaller a tank of this type, the more easily it is mounted on the ship, and therefore, in this embodiment, four small LNG tanks 5 are mounted in each of the holds 2 as shown in FIG. 1 and FIG. 2. Further, when the tank is small, its horizontal cross sectional area becomes small, which has a merit that a phenomenon that a liquid cargo violently sloshes in the tank (sloshing) at the time of heavy weather does not easily occur and damage to a cold insulator on an inner surface of the tank is reduced.

The LNG tanks 5 each include a prismatic tank 6, on whose inner surface a cold insulator 7 (for example, reinforced polyurethane foam) is affixed, and it is further covered by a membrane (primary barrier) 8 made of a cryogenic material such as Invar without leaving any space therebetween. Incidentally, when necessary, the cold insulator 7 can have a double-layer structure and a secondary barrier can be provided therebetween. In a conventional membrane-type LNG tank, a cold insulator and a membrane are affixed directly on a surface of an inner hull (that is, an inner bottom and longitudinal bulkheads) of a double hull structure, but the ship of this embodiment is characterized in that a similar thermal insulation barrier work is done not on the inner hull but on the inner surface of the prismatic tank.

In order to prevent the tank from deforming when the LNG tank 5 is lifted up so as to be mounted on the main ship or when a liquid cargo is loaded, the prismatic tank 6 needs to have sufficient rigidity. For this purpose, strength members 9 are vertically and horizontally disposed on outer surfaces of the prismatic tank 6, and for reinforcement, small stiffeners 10 are closely attached between these strength members. The prismatic tank 6 does not come into direct contact with the liquid cargo (LNG) and thus need not be made of a cryogenic material such as an aluminum alloy and can be a steel tank.

The LNG tank 5 assembled on land is lifted up by a crane and is mounted on the main ship in a manner that it is hung down into the hold 2 (FIG. 3). Strength members 11 are welded to the inner bottom 1*a* and the longitudinal bulkheads 1*b* in the hold in advance, and the strength members 9 disposed on the outer surfaces of the LNG tank 5 are welded to these strength members in an overlapping manner or in an abutting manner. Further, as shown in FIG. 2, strength members 11 are attached in advance also on transfer bulkheads 12 each separating the hold 2 and the hold 2, and the strength members 9 disposed on a front surface or a rear surface of the tank are welded to these strength members. Further, the strength members 9 projecting from facing surfaces of the left and right tanks 5, 5 and those projecting from facing surfaces of the front and rear tanks 5, 5 are also welded together. Since in-situ welding is thus necessary at the time of the installment of the LNG tanks, work spaces 13 where a worker performs a welding work are left between the prismatic tanks 6 and the inner hull 1, between the prismatic tanks 6 and the transfer bulkheads 12, and between the adjacent tank 5 and tank 5. The inner bottom 1*a* and the longitudinal bulkheads 1*b* are kept away from cold heat of the LNG tanks 5 by these spaces 13 and can be kept at a temperature slightly lower than room temperature. Therefore, as a structural material of the inner bottom and the longitudinal bulkheads, high-tension steel (this has a property that its strength reduces at low temperatures) is usable, which can reduce construction cost.

The prismatic tanks 6 of the respective LNG tanks are each coupled to the double-hull structure via the strength members 9, 11 in this manner, so that the LNG tanks 5 are firmly supported by the hull. Further, at places where the tanks 5 are adjacent to each other, the strength members 9 are mutually coupled, so that strength unity is similarly maintained. Since the LNG tanks of this ship each are not a completely independent tank as described above, the prismatic tanks 6 need not have strength as high as that of the aforesaid self-supporting prismatic independent tank.

After the mounting of the LNG tanks 5 in the hold 2 is finished, a steel board 14 is affixed to close the tops of the tanks (FIG. 3).

Figure 4:
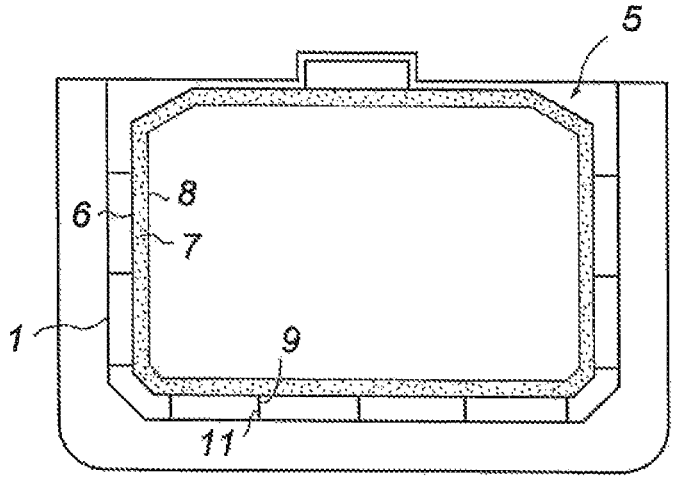
FIG. 4 is a cross section of a center portion of a hull of a LNG ship showing another example.

FIG. 4 shows a case where the LNG tanks 5 are housed in the hold 2 in one line, which is a structure suitable for a relatively small ship.

The tank structures described above are also applicable when an existing ship is remodeled into a LNG ship. In this case, it is possible to fabricate and prepare the LNG tank 5 that is to be mounted on a main ship, on a dock before the main ship enters the dock for the remodeling, and this has a characteristic of being capable of greatly shortening a construction period for the remodeling.

Figure 5:
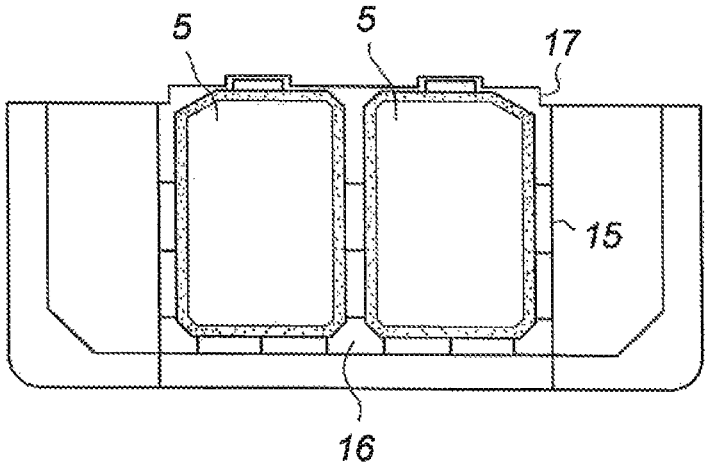
FIG. 5 is a cross section of a center portion of a hull of a LNG ship remodeled from an oil and ore carrier.

An example of a ship easily remodeled into a LNG ship is an ore carrier or an oil and ore carrier. FIG. 5 shows a case where the oil and ore carrier is remodeled, and an ore hold formed between left and right longitudinal bulkheads 15, 15 is used as a hold 16 as it is, and in the hold 16, several LNG tanks 5, for example, totally four in two columns and two rows, are arranged. The ore carrier has a hatchway 17 on an upper deck, and therefore by using this, the LNG tanks 5 can be mounted in the hold from here. The hatchway is closed later.

Figure 6:
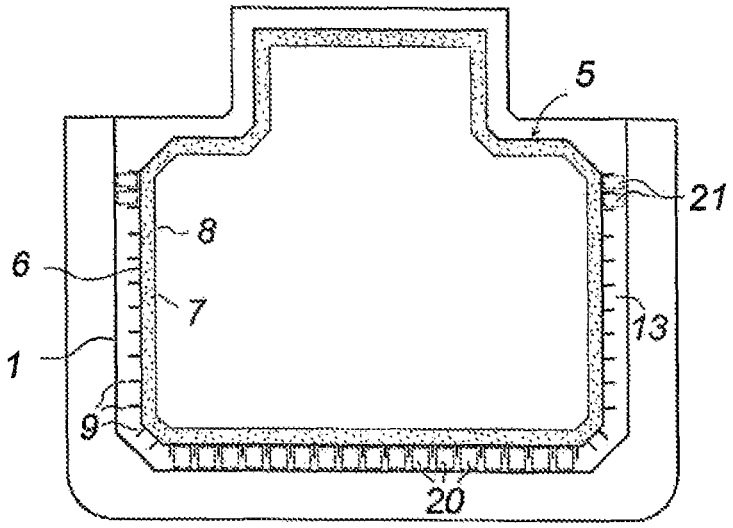
FIG. 6 is a cross-sectional view of a center portion of a hull of a LNG ship showing still another example.

In the above-described structures (FIG. 1 to FIG. 5), the spaces 13 are formed between the LNG tanks 5 and the inner hull 1 and the inner hull 1 is kept away from the cold heat of the LNG tanks 5, so that the inner hull 1 does not easily decrease in temperature. The structure in FIG. 6 further reduces the influence of low temperature to the inner hull 1. In this structure, strength members 9 attached on outer surfaces of a prismatic tank 6 are not connected to an inner hull 1 but are separated therefrom. This prevents the cold heat of a LNG tank from moving directly to the inner hull 1 through the strength members 9. Instead, almost in the same manner as in the case of a self-supporting prismatic LNG tank of an SPB type, a bottom portion of the tank is supported by lower portion support blocks 20 and further, an upper portion of the tank is supported by upper portion support blocks 21 in order to prevent the displacement of the tank in a horizontal direction. As these support blocks 20, 21, materials having a good heat insulating property, for example, a wood or the like is usable. This makes it further difficult for the inner hull 1 to be influenced by the low temperature from the LNG tank and widens a range where high-tension steel is usable.

BRIEF DESCRIPTION OF REFERENCE

1 inner hull
2 hold
5 LNG tank
6 prismatic tank
7 cold insulator
8 membrane
9 strength member
11 strength member
13 space

The invention claimed is:

1. A method of manufacturing a liquefied natural gas carrier comprising:

a step of forming a liquefied natural gas tank on land by assembling a prismatic tank with prismatic tank-side strength members for reinforcement, which are disposed on and welded to an outer surface of the prismatic tank along a vertical direction and a horizontal direction of the prismatic tank so as to project therefrom and by performing a thermal insulation barrier work on an inner surface of the prismatic tank;

a step of forming a hold of a ship, the hold having a double hull structure having an inner hull and a shell plate;

a step of mounting the liquefied natural gas tank in the hold of the ship; and a step of joining the prismatic tank-side strength members disposed on and welded to the outer surface of the prismatic tank along the vertical direction and the horizontal direction of the prismatic tank, to inner hull-side strength members welded to the inner hull of the ship so as to project therefrom.

2. The method of manufacturing the liquefied natural gas carrier according to claim 1, wherein the liquefied natural gas tanks are installed in the hold, being arranged from left to right of the hold.

* * * * *